US005228356A

United States Patent [19]

Chuang

[11] Patent Number: 5,228,356

[45] Date of Patent: Jul. 20, 1993

[54] VARIABLE EFFORT JOYSTICK

[76] Inventor: Keh-Shih K. Chuang, 15 San Vicente Ct., Danville, Calif. 94526

[21] Appl. No.: 797,383

[22] Filed: Nov. 25, 1991

[51] Int. Cl.[5] ..... G05G 9/00

[52] U.S. Cl. ..... 74/471 XY; 74/89.22; 200/6 A; 273/148 B; 340/709; 341/20

[58] Field of Search ..... 74/471 XY, 89.21, 89.22, 74/483 PB, 89.15; 200/6 A; 273/148 B, 438; 340/709; 364/482; 341/20

[56] References Cited

U.S. PATENT DOCUMENTS

| | | | |
|---|---|---|---|
| 2,424,773 | 7/1947 | Reiber | 200/6 A |
| 2,984,720 | 5/1961 | Fisher | 200/6 A |
| 3,091,130 | 5/1963 | Payerle et al. | 74/471 XY |
| 3,550,466 | 12/1970 | Ham | 200/6 A |
| 3,707,093 | 12/1972 | Worden | 74/471 XY |
| 3,940,674 | 2/1976 | Gill | 74/471 XY |
| 4,127,841 | 11/1978 | Kato et al. | 74/471 XY |
| 4,200,780 | 4/1980 | Romano | 200/302 |
| 4,216,467 | 8/1980 | Colston | 74/471 XY |
| 4,414,438 | 11/1983 | Maier | 200/6 A |
| 4,491,325 | 1/1985 | Bersheim | 273/148 B |
| 4,509,383 | 4/1985 | Yeh | 74/471 XY |
| 4,532,817 | 8/1985 | Chaki | 74/483 PB |
| 4,533,899 | 8/1985 | Isaksson | 338/128 |
| 4,584,443 | 4/1986 | Yaeger | 200/6 A |
| 4,590,339 | 5/1986 | Scott | 200/6 A |
| 4,660,828 | 4/1987 | Weiss | 273/438 |
| 4,685,678 | 8/1987 | Frederiksen | 273/148 B |
| 4,748,441 | 5/1988 | Brzezinski | 340/709 |
| 4,766,423 | 8/1988 | Ono | 340/709 |
| 4,769,517 | 9/1988 | Swinney | 200/6 A |
| 4,800,721 | 1/1989 | Cemenska | 60/393 |
| 4,814,682 | 3/1989 | Yamada | 318/640 |
| 4,820,162 | 4/1989 | Ross | 434/45 |
| 4,870,389 | 9/1989 | Ishiwata | 340/709 |
| 4,879,556 | 11/1989 | Duimel | 74/471 XY |
| 4,947,701 | 8/1990 | Hegg | 74/471 XY |
| 4,962,448 | 10/1990 | DeMaio et al. | 74/471 XY |
| 5,087,904 | 2/1992 | DeVolpi | 74/471 XY |

*Primary Examiner*—Rodney H. Bonck
*Assistant Examiner*—Ryan W. Massey
*Attorney, Agent, or Firm*—Timothy T. Tyson

[57] ABSTRACT

A variable resistance joystick (20) configured for computer control is provided. A stepper motor (34) turns threaded screws (30) to move a system of springs (26) up and down on the joystick thus varying the lever arm on which the springs impart force. Thus computer commands (113) to the stepper motor may change the force required by a user to move the joystick. A similar system controls the resistance to movement of a button (108) in the joystick handle (42).

17 Claims, 4 Drawing Sheets

VARIABLE EFFORT JOYSTICK

TECHNICAL FIELD

The present invention pertains to computer joysticks and, more particularly, to computer controlled variable effort joysticks.

BACKGROUND ART

Input devices allow a user to place information into a computer. The most common input devices are probably keyboards, mice, graphics tablets and joysticks. The joystick is particularly useful in activities requiring hand-eye coordination such as game playing and computer training programs. Computer training programs are used to teach people to handle a variety of tasks such as flying airplanes, controlling satellites, operating ship loading equipment and performing surgical operations.

When many of these activities are performed in the actual situation there is a resistive feedback to the performer. For instance, in flying an airplane the control stick may require more force to move when the stick is moved to extreme positions. Or in performing an operation it may require more force to cut through some tissues than it does for others.

Therefore, it may be useful to have a system in which the joystick has a variable resistance to movement with that resistance under computer control. The computer can then cause the joystick to have a resistance to movement for each program activity that matches the resistance to be found in the real life activity.

The following U.S. Patents are of interest in the joystick art; U.S. Pat. Nos. 4,127,841, 4,156,130, 4,200,780, 4,216,467, 4,414,438, 4,491,325 4,509,383 4,533,899, 4,590,339, 4,685,678, 4,748,441, 4,766,423, 4,769,517 4,800,721 4,814,682, 4,820,162, 4,870,389 and 4,879,556.

DISCLOSURE OF INVENTION

The present invention is directed to apparatus enabling computer control of the resistance required to move a joystick or parts thereof.

Apparatus in accordance with the invention are characterized by the use of a computer controlled stepper motor to alter the lever arm available to springs for urging of the joystick and a button in the joystick handle. A user of the joystick and the button must overcome the applied spring force.

MODES FOR CARRYING OUT THE INVENTION

Figure 1:
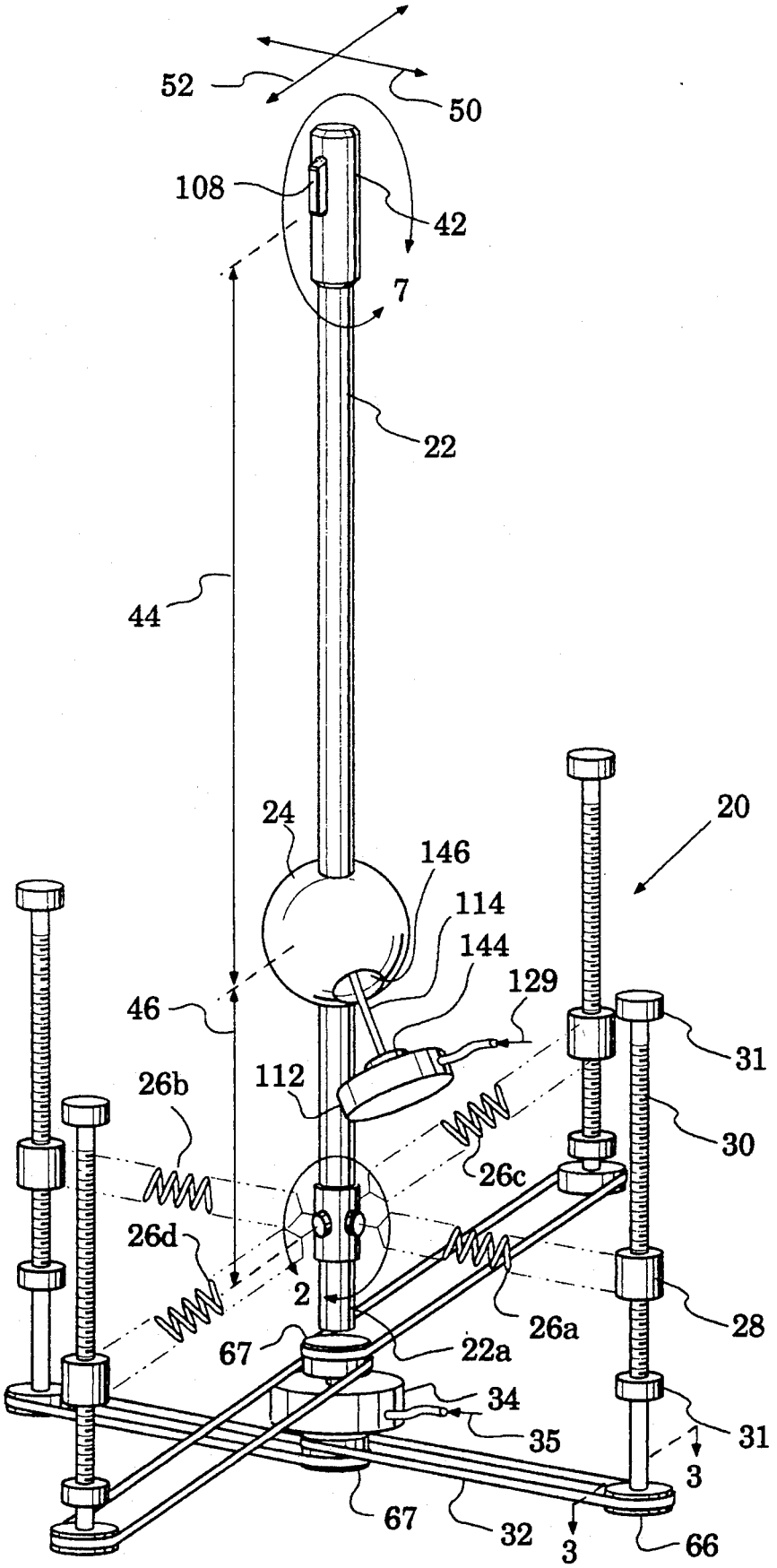
FIG. 1 is an isometric view of a joystick disposed with a preferred apparatus embodiment, in accordance with the present invention, for converting it to a variable effort joystick.

FIG. 1 is an isometric view of a preferred apparatus embodiment 20 for converting a joystick 22 to a variable effort joystick. The joystick 22 rotates about a ball joint 24 (indicated schematically by a sphere). Springs 26 are movably attached at one end thereof to a portion 22*a* of the joystick 22 and, at another end thereof, to threaded nuts 28 engaged by threaded screws 30 which rotate within bearings 31. The screws 30 are disposed substantially parallel to the neutral position of the joystick 22 and are rotated by the use of belts 32 driven by a stepper motor 34 which is responsive to computer commands 35 in manners well known in the art.

Thus the springs 26 may be moved axially along the joystick portion 22*a* in response to computer commands 35. Since a user of the joystick 22 normally applies force to the handle 42 it is seen that the user has the advantage of a lever arm of distance 44 (to the ball joint 24) while the springs 26 urge the joystick 22 with a lever arm of distance 46 and the effort, therefore, required of the user to move the joystick is proportional to the ratio expressed by distance 46/distance 44. The movement of the nuts 28 parallel to the joystick axis (which changes the distance 46) is a linear function of the rotation of the stepper motor 34 and the effort required of the joystick user is, therefore, a linear function of the stepper motor 34 rotation.

It may be appreciated from FIG. 1 that the force of the springs 26*a*, 26*b* and the distances 44, 46 determine the user effort at the handle 42 along the direction 50 while the force of the springs 26*c*, 26*d* and the distances 44, 46 determine the effort along the direction 52. Efforts to move the handle 42 along directions which are a vectorial combination of the directions 50, 52 are determined by a corresponding vectorial combination of the force of the springs 26*a*, 26*b* and 26*c*, 26*d*. The springs 26 have been shown to engage a portion 22*a* of the joystick 22 separated by the ball joint 24 from the handle 42 but the apparatus may also be configured to have the springs engage the joystick 22 on the same side of the ball joint 24 as the handle 42.

Figure 2:
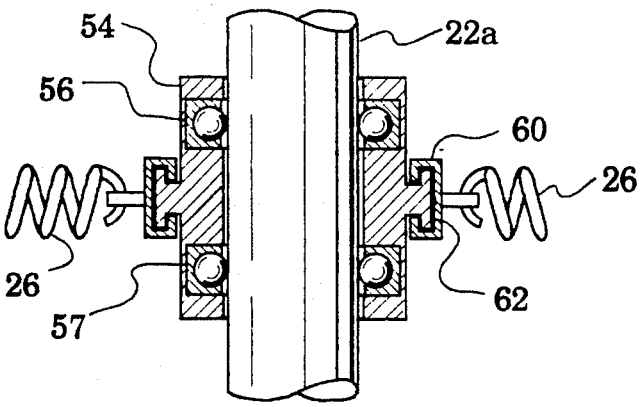
FIG. 2 is an enlarged sectional view of the area enclosed by the line 2 in FIG. 1.

FIG. 2 is an enlarged sectional view of the area enclosed by the line 2 in FIG. 1 and illustrates that the springs 26 are attached to a sleeve 54 whose movements along the portion 22*a* are facilitated by a set of roller bearings 56, 57 which roll thereon. The springs 26 are attached to cups 60 which rotate on circular bosses 62 of the sleeve 54. The cups 60 and bosses 62 accommodate movements of the portion 22*a* that are transverse to the plane that a spring is in prior to movement of the joystick 22. The attachement of the springs 26 to the cups 60 and to the nuts (28 in FIG. 1) may be accomplished in various manners well known in the art.

Figure 3:
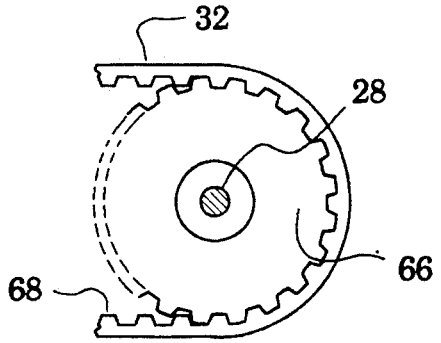
FIG. 3 is an enlarged view along the plane 3—3 of FIG. 1.

The belts 32 are operatively connected between the stepper motor 34 and the screws 30 by sheaves 66, 67 (although they are not shown in the figures, such sheaves commonly have flanges for containment of a belt therewithin). As shown in FIG. 3, which is a view along the plane 3—3 of FIG. 1, the belts 32 may have teeth 68 that mesh with corresponding teeth in the sheaves 66. Thus a rotational relationship may be maintained between the stepper motor 34 and the screws 30.

Figure 4:
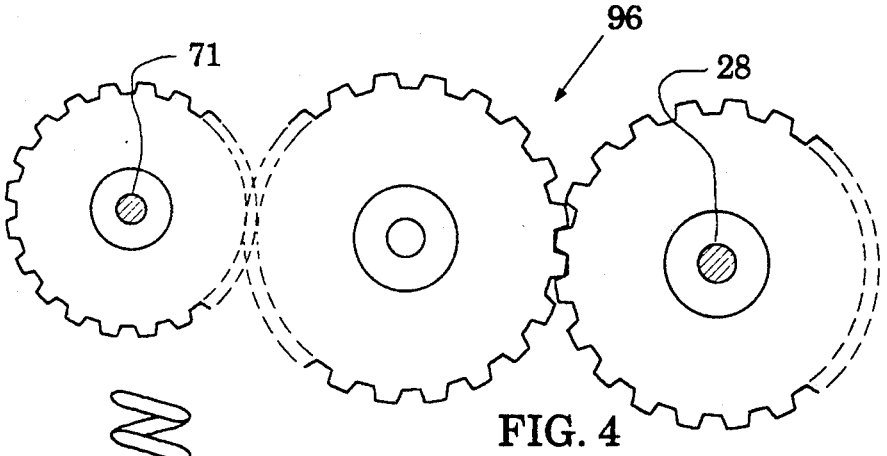
FIG. 4 is a plan view of a gear train for another preferred apparatus embodiment.

FIG. 4 is a plan view of a gear train 96 that may be substituted for the sheaves 66 and belts 32 of FIGS. 1 and 3 to operatively connect the stepper motor 34 (through its axle 71) and the screws 30 in another preferred embodiment of the invention.

Figure 5:
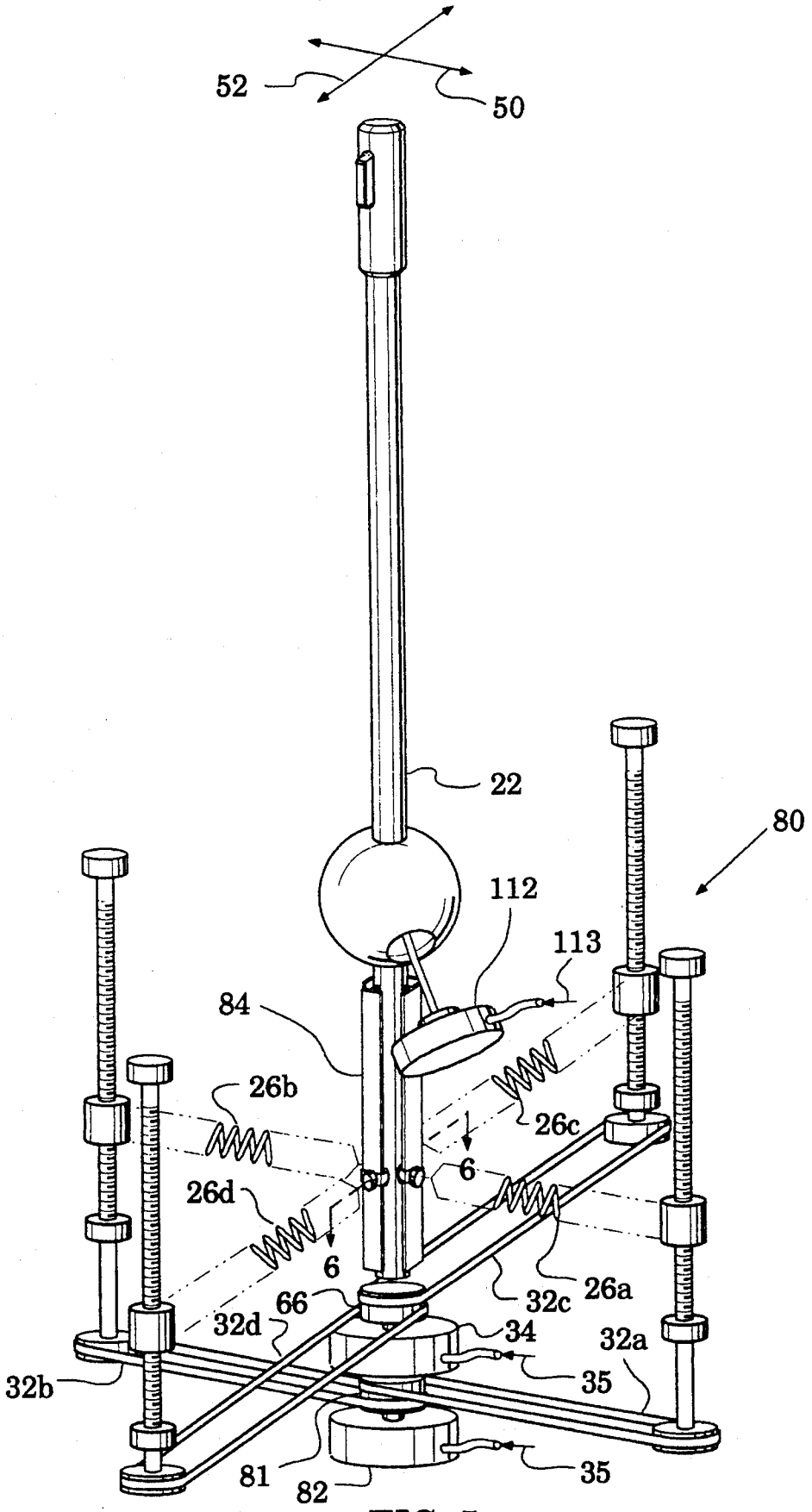
FIG. 5 is a view similar to FIG. 1 illustrating another preferred embodiment of the present invention disposed with a joystick.

FIG. 5 is a view similar to FIG. 1 illustrating another preferred apparatus embodiment 80 which enables independent computer control of the variable effort along directions 50 and 52. A second stepper motor 82, through a sheave 81 and belts 32*a*, 32*b* controls the movement of springs 26*a*, 26*b* while the first stepper motor 34 controls, through a sheave 67 and belts 32*c*, 32*d*, movement of springs 26*c*, 26*d*.

Figure 6:
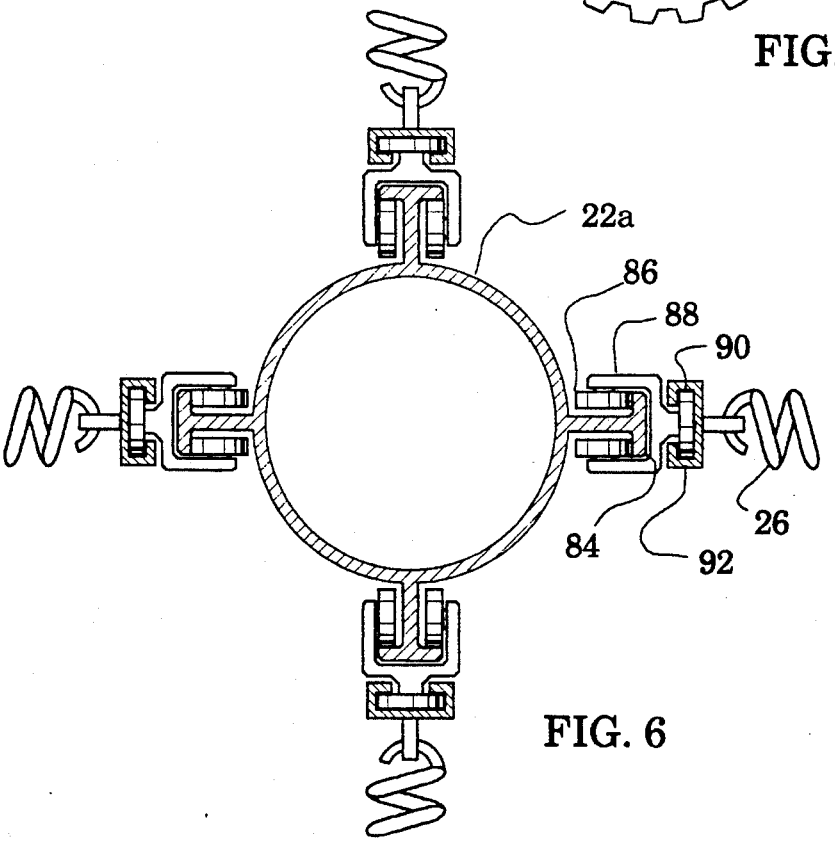
FIG. 6 is a view along the plane 6—6 of FIG. 5.

This independent movement is enabled, as shown in FIG. 6 which is a sectional view along the plane 6—6 of FIG. 5, by tracks 84 disposed axially on the section 22*a* and wheels 86 which rotatably bear on the tracks 84. The wheels 86 rotate within yokes 88 which terminate in discs 90 which, in turn, rotate within cups 92. Thus, as seen in FIGS. 5, 6, a computer may independently control the effort required of a user of the joystick 22 along the directions 50, 52, by commanding stepper motors 34, 82 to adjust the axial movement along the joystick section 22*a* of, respectively, springs 26*c*, 26*d* and springs 26*a*, 26*b*.

Figure 7:
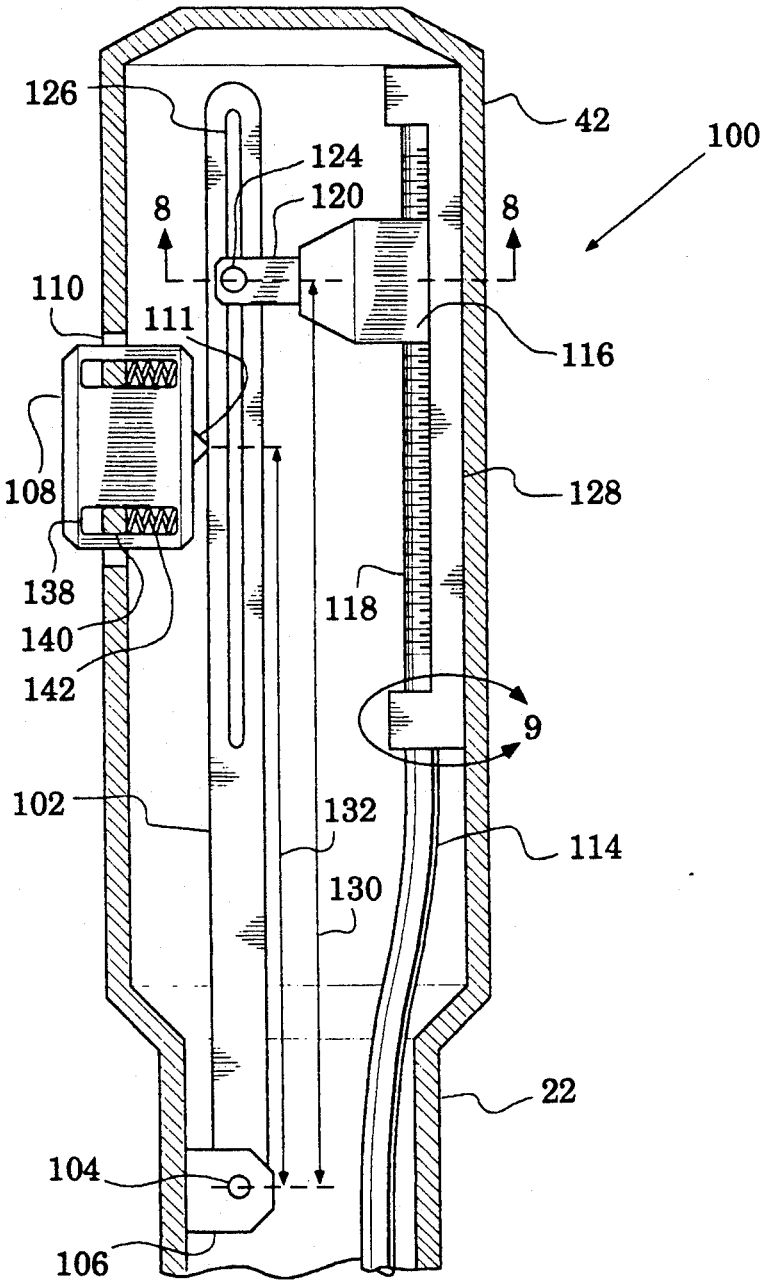
FIG. 7 is an enlarged sectional view of the area enclosed by the line 7 of FIG. 1.

FIG. 7 is an enlarged sectional view of the area enclosed by the line 7 of FIG. 1 illustrating another preferred apparatus embodiment for converting the joystick 22 to one requiring variable effort from a user thereof. A lever 102 is disposed about a pivot 104 mounted in a boss 106 and a button 108, disposed in an aperture 110 of the handle 42, abuts the lever 102 through a pointed boss 111. As seen in FIGS. 1 and 7, a stepper motor 112 controls, through a flexible cable 114 the movement of a nut 116 along a threaded screw 118 which is substantially parallel to the lever 102.

Figure 8:
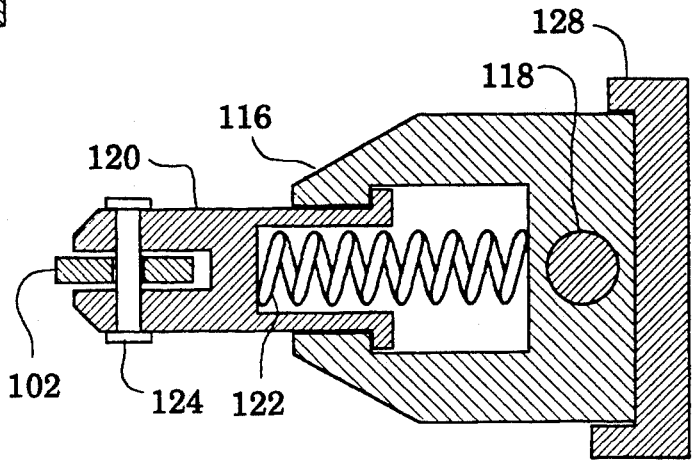
FIG. 8 is a sectional view along the line 8—8 of FIG. 7.

FIG. 8 is an enlarged sectional view along the plane 8—8 of FIG. 7 showing a plunger 120 that moves within the nut 116 under urging of a spring 122. As seen in FIGS. 7, 8 the plunger 120 carries a pin 124 that is slidingly received within a slot 126 of the lever 102. The nut 116 slides within a track 128 mounted within the handle 42.

Therefore, in a manner similar to that described above relative to FIG. 1, the stepper motor 112 can, in response to computer commands 129, alter the lever arm distance 130 available to the plunger 116 while the button 108 always uses a lever arm distance 132. Thus the effort required by a user of the joystick to depress the button 108 may be varied by computer control.

Figure 9:
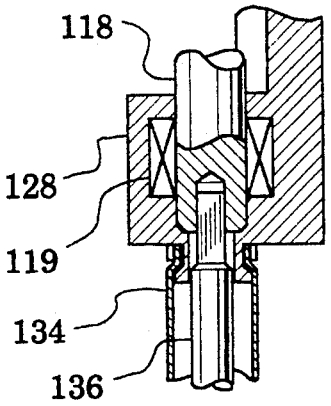
FIG. 9 is an enlarged sectional view of the area enclosed by the line 9 of FIG. 7.

FIG. 9 is an enlarged sectional view of the area enclosed by the line 9 of FIG. 7 illustrating that the cable 114 has an outer sleeve 134 and a coaxial inner core 136 that rotatably engages the screw 118 which rotates in bearings 119 disposed in the track 128. The cable is of a type well known in mechanical arts (e.g. automobile speedometer cables).

The button 108 is shown in FIG. 7 to slide by means of slots 138 received over bosses 140 of the handle 42. Small springs 142 urge the button against the lever 102 to secure the button 108 when not in use.

The stepper motor 112 shown in FIG. 5 may be operatively connected to the core 136 through structure 144 well known in the mechanical arts (e.g. gear train or belt). The ball joint 24 schematically illustrated in FIG. 1 by a sphere has an orifice 146 configured so that the ball joint 24 does not abut the cable 114 as the joystick 22 is moved. Since the ball joint 24 is shown schematically is should be understood that the orifice 146 is also a schematic representation indicating that an actual ball joint must be configured to allow flexing of the cable 114 without impinging upon it.

Thus it should be apparent that apparatus embodiments have been disclosed herein enabling computer control of the effort required to operate a joystick by a user thereof.

The embodiments depicted herein are exemplary and numerous modifications and rearrangements can be made with the equivalent result still embraced within the scope of the invention.

What is claimed is:

1. Apparatus, comprising:
a first stepper motor responsive to computer commands;
first exerting means, movably attached to a joystick which is operative about a ball joint, for exerting force transversely on said joystick; and
first means, responsive to said stepper motor, for moving said first exerting means axially along said joystick;
whereby the effort required to move said joystick by a user thereof may be varied by said computer commands.

2. Apparatus as defined in claim 1 wherein said first exerting means comprises a spring for generating said force.

3. Apparatus as defined in claim 1 wherein said first exerting means comprises a roller bearing disposed on said joystick to facilitate axial movement of said first exerting means thereon.

4. Apparatus as defined in claim 1 wherein said first exerting means comprises:
a track disposed axially on said joystick; and
a wheel disposed on said track to facilitate movement of said first exerting means relative thereto.

5. Apparatus as defined in claim 1 wherein said first moving means comprises:
a belt operatively engaged by said stepper motor;
a threaded screw disposed substantially parallel to said joystick and operatively engaged by said belt for axial rotation of said screw; and
a threaded nut attached to said first exerting means and rotatably engaged by said screw.

6. Apparatus as defined in claim 5 wherein said belt defines a plurality of teeth facilitating maintenance of a rotational relationship between said first stepper motor and said screw.

7. Apparatus as defined in claim 1 wherein said first moving means comprises:
a threaded screw disposed substantially parallel to said joystick;
a gear train operatively disposed between said stepper motor and said threaded screw for axial rotation of said threaded screw; and
a threaded nut attached to said first exerting means and rotatably disposed on said threaded screw.

8. Apparatus as defined in claim 1 wherein said first exerting means is disposed to exert said force on a portion of said joystick separated by said ball joint from the portion of said joystick upon which a user thereof exerts a force.

9. Apparatus as defined in claim 1 wherein said first exerting means is disposed to exert said force on a portion of said joystick on the same side of said ball joint as the portion of said joystick upon which a user thereof exerts a force.

10. Apparatus as defined in claim 1, further comprising:

a second stepper motor responsive to computer commands;

a lever disposed within said joystick to be abutted by a button movably mounted in said joystick;

second exerting means, movably attached to said lever, for exerting a force transversely thereon; and second means, responsive to said stepper motor, for moving said second exerting means axially along said lever;

whereby the effort required to move said button by a user thereof may be varied by said computer commands.

11. Apparatus, comprising:

a stepper motor responsive to computer commands;

a lever disposed within a joystick to be abutted by a button movably mounted in said joystick;

exerting means, movably attached to said lever, for exerting a force transversely thereon; and moving means, responsive to said stepper motor, for moving said exerting means axially along said lever;

whereby the effort required to move said button by a user thereof may be varied by said computer commands.

12. Apparatus as defined in claim 11 wherein said exerting means comprises a spring for generating said force.

13. Apparatus as defined in claim 11 wherein said lever defines a slot therein and said exerting means comprises a pin disposed in said slot to facilitate movement therein.

14. Apparatus as defined in claim 11 wherein said moving means comprises:

a cable coaxial inner core operatively engaged by said stepper motor for axial rotation thereof;

a threaded screw disposed substantially parallel to said lever and operatively engaged by said cable coaxial inner core for axial rotation thereof; and a nut attached to said exerting means and rotatably engaged by said threaded screw.

15. A method of exerting computer controlled variable forces upon a joystick, comprising the steps of:

providing a first stepper motor responsive to computer commands;

engaging said joystick at an engagement point thereon with a first spring to exert a force transversely on said joystick; and moving, in response to said first stepper motor, said first spring and said engagement point on said joystick;

whereby the effort required to move said joystick by a user thereof may be varied by said computer commands.

16. A method as defined in claim 15 wherein said moving step comprises the steps of:

attaching said first spring to a threaded nut;

disposing a threaded rod responsive to said stepper motor substantially parallel to said joystick; and engaging said threaded nut with said threaded rod.

17. A method as defined in claim 15 further comprising the steps of:

providing a second stepper motor responsive to computer commands;

abutting a button movably mounted in said joystick with a lever;

engaging said lever with a second spring to exert a force transversely thereon; and moving, in response to said second stepper motor, said second spring axially along said lever;

whereby the effort required to move said button by a user thereof may be varied by said computer commands.

* * * * *